US010833430B2

(12) United States Patent
Vanzetto

(10) Patent No.: US 10,833,430 B2
(45) Date of Patent: Nov. 10, 2020

(54) TERMINAL FOR CONNECTING AN ELECTRICAL CONDUCTOR TO THE CONNECTION PAD OF AN ELECTRICAL DEVICE, AND ELECTRICAL PROTECTION DEVICE INCLUDING SUCH A TERMINAL

(71) Applicant: Schneider Electric Industries SAS, Rueil Malmaison (FR)

(72) Inventor: Daniel Vanzetto, Claix (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/509,533

(22) Filed: Jul. 12, 2019

(65) Prior Publication Data

US 2020/0091625 A1 Mar. 19, 2020

(30) Foreign Application Priority Data

Sep. 13, 2018 (FR) ..... 18 58204

(51) Int. Cl.
*H01R 4/38* (2006.01)
*H01R 4/36* (2006.01)

(52) U.S. Cl.
CPC ..... *H01R 4/366* (2013.01)

(58) Field of Classification Search
CPC ... H01R 4/30; H01R 4/34; H01R 4/36; H01R 4/363; H01R 4/366
(Continued)

(56) References Cited

U.S. PATENT DOCUMENTS 3,737,839 A * 6/1973 Marechal ..... H01R 4/36 24/115 R
4,027,940 A 6/1977 Mazzeo
(Continued)

FOREIGN PATENT DOCUMENTS

DE 851 651 10/1952
DE 43 09 198 C2 9/1994
(Continued)

OTHER PUBLICATIONS

French Preliminary Search Report dated May 20, 2019 in French Application 18 58204, filed on Sep. 13, 2018 (with English Translation of Categories of Cited Documents & Written Opinion).

*Primary Examiner* — Khiem M Nguyen
(74) *Attorney, Agent, or Firm* — Oblon, McClelland, Maier & Neustadt, L.L.P.

(57) ABSTRACT

A terminal for connecting an electrical conductor to a connection pad of a device, the terminal including a cage to be fixed inside the housing of the device and including an orifice of substantially parallelepipedal shape and delimited by four walls, the orifice being able to receive the pad, an upper wall including an orifice able to allow the passage of a screw with an actuator and a clamping shoe able to allow the conductor to be clamped between the pad and the shoe upon actuation of the screw driving the relative translational movement between the screw and the cage. Terminal includes an intermediate stage inside the cage to allow the reception of a nut with elastic branches having a threaded orifice through which the clamping screw is to be mounted, the elastic branches interacting with forms provided on the side walls of the cage such that the nut rotationally disengages as soon as the correct clamping torque is reached.

12 Claims, 3 Drawing Sheets

Figure 1:
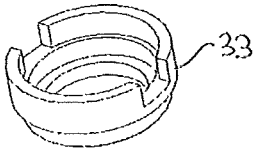

(58) Field of Classification Search
USPC ..... 439/801, 810, 814, 815
See application file for complete search history.

(56) References Cited

U.S. PATENT DOCUMENTS

| | | | | |
|---|---|---|---|---|
| 5,021,014 | A * | 6/1991 | Walter | H01R 4/363 439/798 |
| 6,186,839 | B1 * | 2/2001 | Storey | H01R 4/363 439/811 |
| 10,027,039 | B1 * | 7/2018 | Smith | H01R 4/60 |

FOREIGN PATENT DOCUMENTS

| | | |
|---|---|---|
| EP | 2 725 660 A1 | 4/2014 |
| EP | 3 185 368 A1 | 6/2017 |
| FR | 2 814 595 A1 | 3/2002 |

* cited by examiner

TERMINAL FOR CONNECTING AN ELECTRICAL CONDUCTOR TO THE CONNECTION PAD OF AN ELECTRICAL DEVICE, AND ELECTRICAL PROTECTION DEVICE INCLUDING SUCH A TERMINAL

TECHNICAL FIELD

The present invention relates to a terminal for connecting an electrical conductor to a connection pad belonging to an electrical device, such a terminal including a cage able to be fixed inside the housing of the device and including an orifice of substantially parallelepipedal shape and delimited by four walls, this orifice being able to receive said pad, one of said walls of the cage including an orifice able to allow the passage of a screw, said screw including, at one of its ends situated outside the cage, means for actuating said screw, and, at its opposite end, a clamping shoe able to allow the conductor to be clamped between said pad and said shoe upon actuation of the screw driving the relative translational movement between the screw and the cage.

The present invention also relates to an electrical protection device including such a terminal.

PRIOR ART

A so-called screw terminal of the aforementioned kind is described for example in the patent EP 0 555 157.

The electrical connection of power cables to connection pads of circuit-breakers is a recurrent concern for reasons of safety of persons and goods.

In fact, installers working on site do not have torque wrenches enabling tightening of the various connection points to the correct torque. These torque wrenches are costly and have to be calibrated approximately once a year.

Moreover, these wrenches sometimes do not have the right selection of torques corresponding to a particular range.

As a result the devices are sometimes tightened intuitively by an increasingly unskilled workforce. The result of this is that it is necessary to carry out retightening campaigns intended to ensure compliance with the clamping torques recommended by the manufacturers.

The present invention solves this problem and proposes a connecting terminal enabling simple and economic tightening to the correct torque of the conductor in the terminal, and an electrical protection device including such a terminal.

SUMMARY OF THE INVENTION

To this end, the present invention consists in a connecting terminal of the aforementioned kind, that terminal being characterized in that it includes an intermediate stage created inside the cage so as to allow the reception of a nut with elastic branches having a threaded orifice through which the clamping screw is intended to be mounted in a screwed manner, said elastic branches interacting with forms provided on the side walls of the cage such that the nut rotationally disengages from the screwing as soon as the correct clamping torque is reached, and engages from the start to the end of the unscrewing.

According to one particular feature, the two elastic branches are able to be compressed radially upon screwing onto tracks belonging to the cage, the torque resulting from the compression of the branches opposing the torque tightening the screw until these branches escape from the slopes as soon as the required clamping torque is reached.

According to one particular feature, this terminal includes means for producing a clicking sound as soon as the aforementioned escape of the branches from the slopes.

According to another feature the aforementioned nut includes an annular part including the orifice through which the aforementioned screw passes and from which depart two elastic branches extending circumferentially around this annular part in respective opposite directions.

According to another feature each branch includes at its free end an attachment element able to cooperate with first and second recessed forms provided on each side wall of the cage, each element forming a hook cooperating with a so-called first recessed form during clamping and with a so-called second recessed form during unscrewing.

According to another feature the aforementioned so-called first and second recessed forms are produced by stamping the inside of the side walls of the cage.

According to another feature in each side wall the two recessed forms extend in a direction substantially perpendicular to the axis of the cage, the two recessed forms of one side wall of the lateral side being disposed in an opposite manner to the two recessed forms of the other side wall.

According to another feature each so-called first recessed form includes a surface portion forming an attachment slope situated facing the so-called second recessed form of the same wall, the passage via this attachment slope for the attachment element to rejoin the second recessed form leading to the aforementioned disengagement from the screw.

According to another feature each so-called second recessed form includes, situated facing the so-called first recessed form associated with it, a wall portion extending substantially perpendicularly to the axis of the cage and forming an abutment stopping rotation of the nut during an unscrewing manoeuvre generating the engagement of the clamping screw from the beginning to the end of unscrewing.

According to another feature the aforementioned intermediate stage is formed by a plate mounted on and crimped to the interior of the cage.

According to another feature this plate includes two so-called first lugs able to be introduced into respective orifices respectively belonging to two edges respectively belonging to the aforementioned two side walls at the end of insertion of the plate in the cage and two so-called second lugs able to be introduced by crimping the sheet metal of the plate into two orifices respectively belonging to the two edges of the side walls opposite the previous edges.

The present invention further consists in an electrical protection device including at least one upstream terminal and/or at least one downstream terminal having the aforementioned features separately or in combination.

Figure 2:
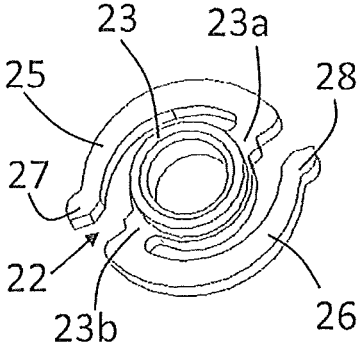
Figure 3:
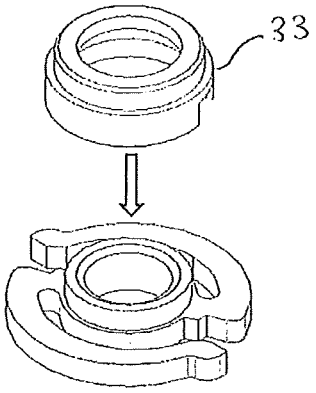
Figure 4:
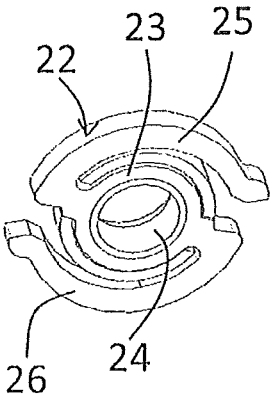
Figure 5:
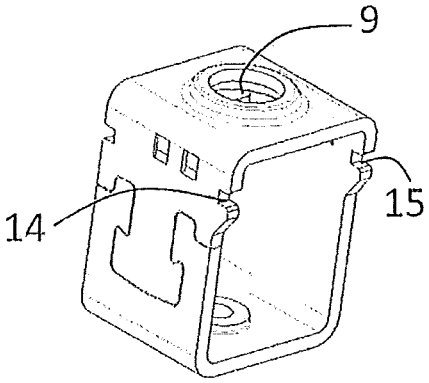
Figure 6:
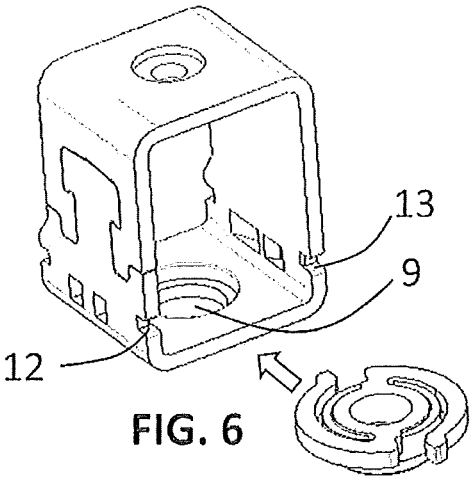
Figure 7:
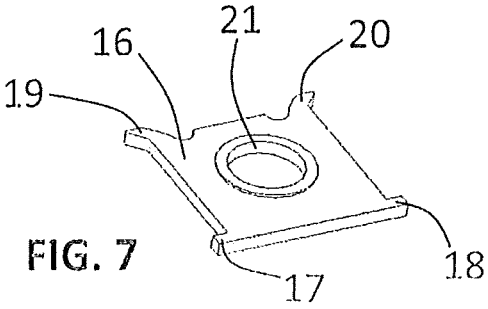
Figure 8:
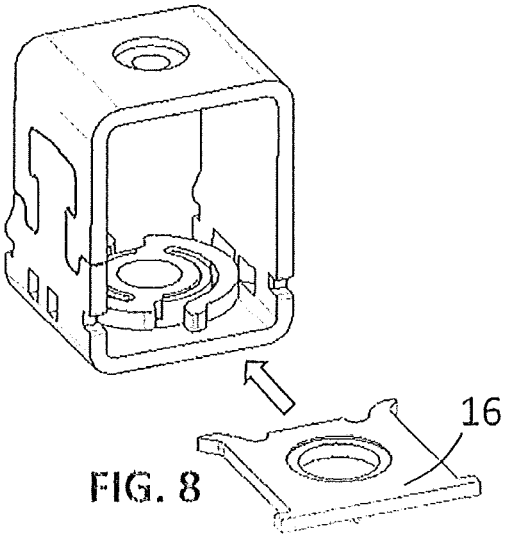
Figure 9:
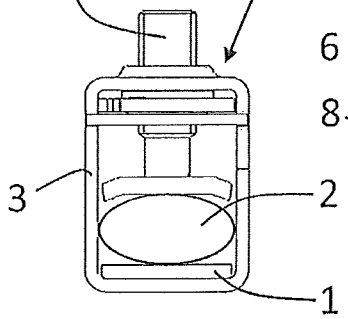
Figure 10:
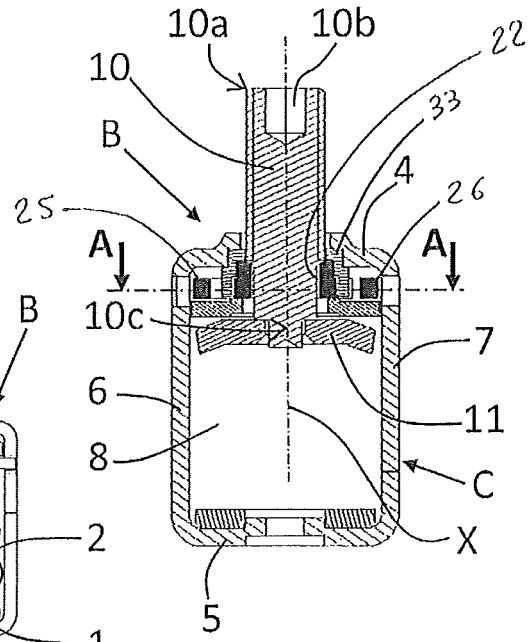
Figure 11:
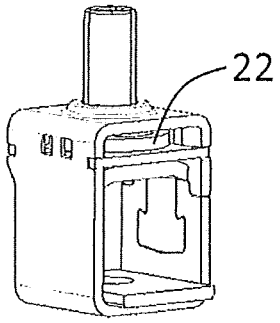
Figure 12:
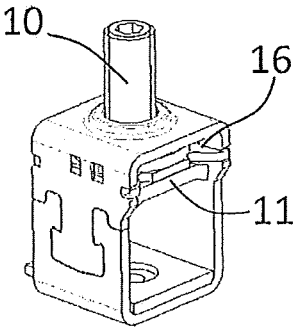
Figure 13:
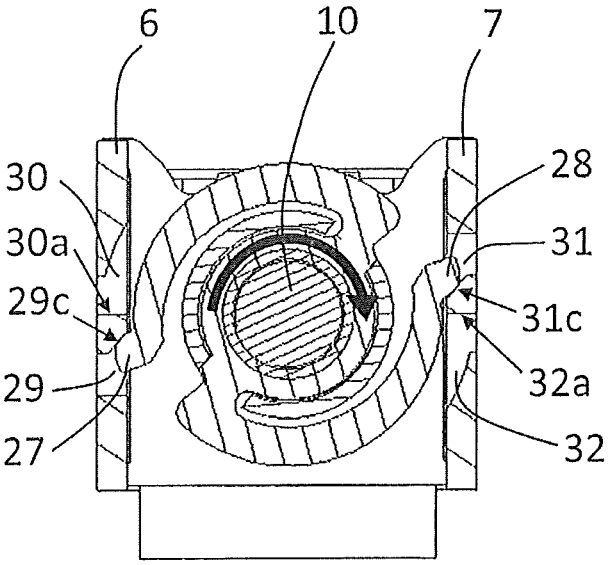
Figure 14:
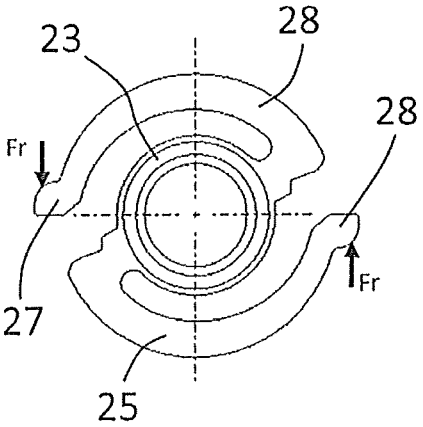

However, other advantages and features of the invention will become more apparent in the course of the following detailed description with reference to the appended drawings provided by way of example only and in which:

FIG. 1 is a perspective view of a friction ring belonging to a terminal according to one particular embodiment of the invention, FIG. 2 is a perspective view of a nut belonging to that same terminal, seen from above, FIG. 3 is a perspective view showing the fitting of this ring to this nut, FIG. 4 is a perspective view of this same nut, seen from below, FIG. 5 is a perspective view of a cage belonging to a terminal according to the invention, FIG. 6 is a perspective view of that same cage before placing the aforementioned nut inside the cage, FIG. 7 is a perspective view of the intermediate plate on its own, FIG. 8 is a perspective view of the aforementioned cage of the terminal after placing the nut inside the terminal and before introducing the intermediate plate, FIG. 9 is a front view of the terminal according to the invention when tightened, FIG. 10 is a view in axial section of the terminal according to the invention in a loosened position, without the cable and without the plate, FIGS. 11 and 12 are perspective views of this same terminal, seen from the insertion side and from the side opposite the insertion side, FIG. 13 is a view in section taken along the line A-A in FIG. 10 showing the nut in the position reaching the slopes and allowing screwing, FIG. 14 is a top view of the nut on its own, in the position from the previous figure, showing the friction force between the cage and the nut, linked to the tightening torque.

Figure 15:
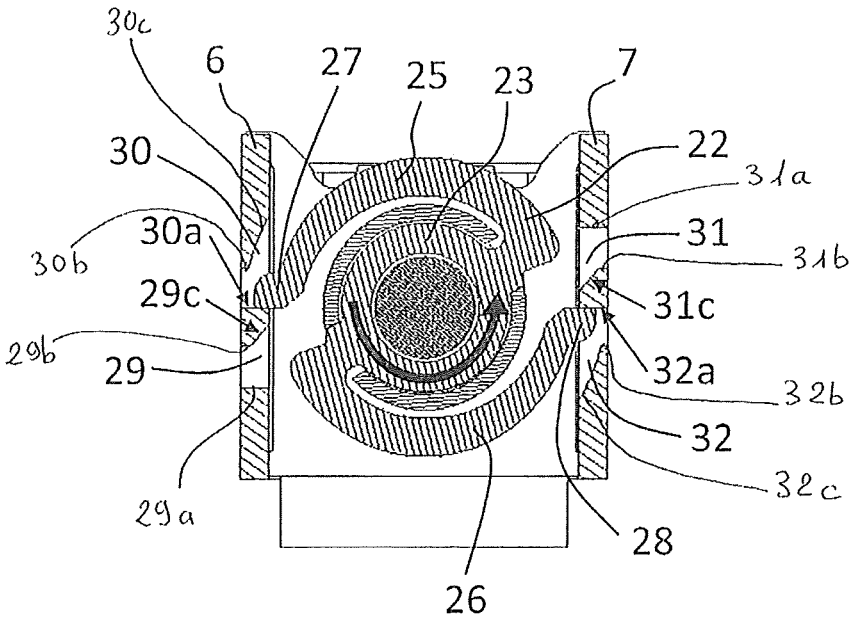
Figure 16:
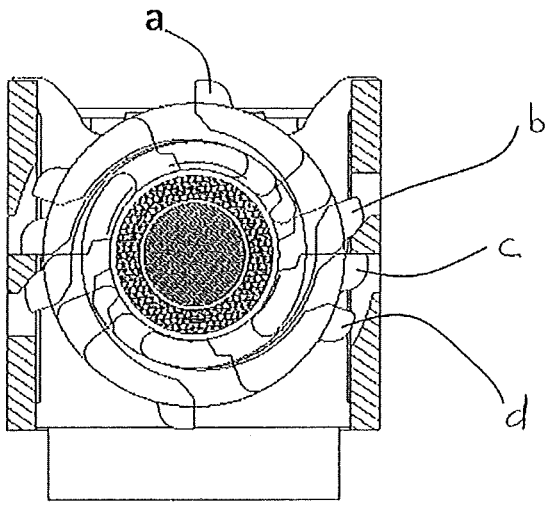

FIG. 15 is a view in section taken along the line A-A in FIG. 10 identical to FIG. 13 but showing the terminal after screwing, in a position allowing unscrewing, and FIG. 16 is a view in section taken along the line A-A showing four different positions of the nut.

In FIG. 10, there is seen a cage C belonging to a connecting terminal B according to the invention, that terminal being intended to be mounted in and fixed to the interior of an electrical protection device such as a low-voltage circuit-breaker in order to enable the electrical connection of a connecting pad 1 of that device to an electrical conductor 2 such as a power cable.

In a manner that is known in itself, this terminal B includes a cage C of substantially parallelepipedal shape consisting of a metal part 3 including four walls 4,5,6,7, parallel two by two, namely an upper wall 4, a lower wall 5, and two side walls 6,7, this set delimiting a through-orifice 8 of substantially parallelepipedal shape intended to receive the free end of the connecting pad 1 of the device. The upper wall 4 of this cage C includes a smooth orifice 9 intended to enable the passage of a clamping screw 10, said screw 10 including at one free end 10*a* a part 10*b* intended to enable its actuation by means of a tool provided for this purpose, whereas its opposite end part 10*c* includes a so-called clamping shoe 11 adapted to come to bear on the conductor to be connected upon actuation of the screw 10 driving its movement in translation relative to the cage C in the direction of the cable 2. It will be noted that this clamping shoe 11 is advantageously fixed to the free end 10*c* of the clamping screw 10 by crimping it on.

As shown in FIGS. 5 and 6, the terminal B according to the particular embodiment of the invention shown includes on each of its side walls 6,7 and on each side of the cage C notches or orifices 12,13,14,15 intended to cooperate with a so-called intermediate plate 16, as shown in FIG. 7, upon introduction of that plate 16 inside the cage C.

This intermediate plate 16, preferably made of metal, therefore includes two so-called first lugs 17, 18 able to be introduced first into respective notches 12,13 of the cage at the end of the introduction of the plate 16 into the cage C, as well as two so-called second lugs 19,20 able thereafter to be introduced into the respective other two notches or orifices 14,15 of the cage C by crimping the sheet metal forming the so-called second lugs, that crimping enabling the intermediate plate 16 to be fastened to the cage C. This intermediate plate 16 also includes a smooth orifice 21 intended to face the smooth orifice 9 of the upper wall 4 of the cage C when fixing the plate 16 to the inside of the cage C.

According to the invention, and as shown in FIGS. 3 to 6, this terminal B also includes a so-called nut part 22, made from an elastic material, and including an annular central part 23 including a threaded orifice 24, that nut 22 being intended to be introduced into the cage C between the upper wall 4 of the cage C and the intermediate plate 16 in such a manner that the three orifices 9,24,21 of the upper wall 4, the nut 22 and the intermediate plate 16, respectively, are aligned.

According to this particular embodiment of the invention, this nut 22 therefore includes an annular part 23 including the aforementioned threaded orifice 24 and two semi-circular branches 25,26 each extending around the aforementioned annular part 23 over approximately half its outside circumference, these two branches 25,26 extending from the exterior surface of this annular part 23 and being connected to that surface at two radially opposite points 23*a*,23*b* (FIG. 2).

This nut 22 is mounted on and centred relative to the cage C, on the one hand, by the introduction of its annular part 23 into the orifice 9 of the upper wall 4 of the cage C and, on the other hand, by the compression exerted by the side walls 6,7 of the cage C on the branches 25,26. The clamping screw 10 passes through the orifices 9,24,21 in the upper wall 4 of the cage C, the nut 22, and the intermediate plate 16, respectively, on being screwed into the threaded orifice 24 of the nut 22.

As shown in FIGS. 1,3 and 10, according to the embodiment shown, the terminal includes a so-called friction ring 33 adapted to be mounted around the annular part 23 of the nut 22 in such a manner as to be constrained to rotate with that nut by means of recesses adapted to cooperate with portions of the nut. This ring is disposed between this annular part and the cage and is intended to control the friction between the various parts.

According to this particular embodiment shown in the drawings, the two branches 25,26 are in one piece with the annular part 23. Each of these two branches 25,26 includes at its free end an element 27,28 forming a hook extending toward the exterior of the annular part 23, these elements being intended to cooperate with recessed forms 29 to 32 or absences of material provided for this purpose, formed on the interior face of the side walls 6,7 in the manner to be explained hereinafter. These absences of material are advantageously produced by punching the internal face of the side walls 6,7 of the cage C.

Accordingly, as shown in FIGS. 13 and 15, each side wall 6,7 includes two [removals of material] 29,30 and 31,32 each forming a notch intended to cooperate with the elements 27,28 forming hooks of the branches 25,26.

A so-called first notch of these notches 29,31 has in cross section an attachment slope, said notch including three successive wall portions 29*a*,29*b*,29*c*,31*a*,31*b*,31*c* at a certain angle relative to one another.

The other, so-called second notch of these notches 30,32 has in cross section an L shape including a wall portion 30*a*,32*a* substantially perpendicular to the side wall 6,7 of the cage C and a curved elongate wall portion 30*c*,32*c* extending in the direction of the interior part of the cage C.

The notches 29 to 32 of the two walls 6,7 are disposed in such a manner that the so-called first notch 29 and second notch 30 of one wall 6 are disposed respectively facing so-called first and second notches 31,32 of the other wall 7 of the walls 6,7.

One wall portion 29*c*,31*c* of the wall portions 29*a*,29*b*, 29*c* and 31*a*,31*b*,31*c* of the so-called first notches 29,31 situated facing the so-called second notch 30,32 constitutes an attachment slope for the element 27,28 forming a hook of the branches 25,26.

The operation of the terminal according to the invention is described hereinafter with reference to FIGS. 9 to 16.

FIG. 9 shows the terminal B in the position with the power cable 2 clamped. In this position, the two elements 27,28 forming hooks are respectively located in the two so-called second notches 30,32, bearing against the face 30*a*,32*a* of that notch forming an abutment that is perpendicular to the side wall 6,7.

In FIGS. 10, 11 and 12 the terminal B is in a loosened position shown in FIGS. 13 and 14, no cable having yet been introduced to its interior.

When the user wishes to clamp a power cable 2 into the terminal B they actuate the screw 10 by rotating it clockwise. This actuation of the screw 10 leads to translational movement of said screw 10 relative to the cage C. This screwing of the screw into the nut 22 drives rotation of the nut in the clockwise direction against the friction torque exerted by the elements 27,28 forming hooks of the branches 25,26 on the internal face of the side walls 6,7 of the cage and compression forces exerted by these walls 6,7 on these elements 27,28 forming hooks. During this rotation of the branches during screwing, these elements 27,28 forming hooks come to abut on the portions 29*c*,31*c* of the first notches 29,31 situated on the side of the second, so-called attachment slope, notches 30,32, and then go to the position represented in FIG. 15 on the other side of these portions after flexing of the branches 25,26, emitting a metallic click indicating that the correct clamping torque has been reached. When screwing continues, a series of metallic clicks is heard.

In this position it is no longer possible to continue screwing because the nut 22 is no longer retained sufficiently firmly to constitute a screwing support.

In this position, actuation of the screw 10 in the loosening direction does not drive rotation of the nut 22 because the elements 27,28 forming hooks of the branches 25,26 are prevented from rotating by the wall portions 30*a*,32*a* forming abutments of the so-called second notches 30,32 that extend perpendicularly to the side walls 6,7 of the cage.

FIG. 16 shows all possible angular positions of the nut 22 during its attachment or free disengagement phases. At a), the screw is in a free rotation position halfway along the branches 25,26, nothing having to project from the terminal. At b), the screw is reaching a position for clamping the branches 25,26 in the clockwise direction. At c), the screw is reaching a position for unscrewing the branches 25,26 in the anticlockwise direction.

At d), the screw is in a disengaged position after clicking on clamping the branches 25,26 in the clockwise direction or reaching a disengagement position on unscrewing in the anticlockwise direction.

There has therefore been provided thanks to the invention a clamping terminal in which an intermediate stage has been created by insertion into the terminal of a metal sheet or plate and a nut, that nut disengaging on screwing rotation as soon as the correct clamping torque is achieved and engaging on unscrewing, metallic clicks being heard on reaching the correct clamping torque.

It will be noted that the cage no longer includes any threaded orifice, but merely includes a smooth orifice.

The screwing torque is opposed by the friction torque exerted between the side walls of the cage and the ends of the branches forming hooks to which is added the resulting torque corresponding to the compression of the branches by the walls during cooperation between the elastic branches and the slopes of the particular forms that are formed by the clearances created in the side walls of the cage.

The user is able to tighten the terminal without a torque wrench, using any tool.

The torque being controlled, the terminal no longer requires the usual mechanical oversizing. It is possible to size the parts of the terminal just as required.

The volume of the terminal is unchanged. The screw is disengaged on unscrewing it, for example using an electric screwdriver.

The shoe allows clamping of two cables with different sections.

This terminal enables clamping to the correct torque by means of any 4 mm hexagonal tool present in the user's toolkit.

It disengages and emits a series of mechanical clicks on reaching the correct torque.

The invention advantageously applies to the field of low-voltage power circuit-breakers, in particular circuit-breakers with a moulded housing.

The clamping torque limiting function is integrated into the terminal. It no longer takes the form of a tool or an accessory.

Of course, the invention is not limited to the embodiment described and shown, which has been given only by way of example.

To the contrary, the invention encompasses all technical equivalents of the means described and their combinations if the latter are produced in accordance with its spirit.

The invention claimed is:

1. A terminal for connecting an electrical conductor to a connection pad belonging to an electrical device, such a terminal comprising a cage able to be fixed inside the housing of the electrical device and including an orifice of substantially parallelepipedal form and delimited by four walls, said orifice being able to receive said pad, one of said walls of the cage, called upper wall, including an orifice able to allow the passage of a screw, said screw including, at one of its ends situated outside the cage, means for actuating said screw, and, at its opposite end, a clamping shoe able to allow the conductor to be clamped between said pad and said shoe upon actuation of the screw driving the relative translational movement between the screw and the cage, wherein an intermediate stage created inside the cage so as to allow the reception of a nut with elastic branches having a threaded orifice through which the clamping screw is to be mounted in a screwed manner, said elastic branches interacting with forms provided on the side walls of the cage such that the nut rotationally disengages upon the screwing as soon as the correct clamping torque is reached, and engages from the start to the end of the unscrewing.

2. The connecting terminal according to claim 1, wherein the two elastic branches are able to be compressed radially upon screwing onto tracks belonging to the cage, the torque resulting from the compression of the branches opposing the torque tightening the screw until these branches escape from the slopes as soon as the required clamping torque is reached.

3. The connecting terminal according to claim 1, comprising means for producing a clicking sound as soon as the escape of the branches from the slopes.

4. The connecting terminal according to claim 1, wherein the nut comprises an annular part including the orifice through which the screw passes and from which depart two elastic branches extending circumferentially around this annular part in respective opposite directions.

5. The connecting terminal according to claim 4, wherein each branch comprises at its free end an attachment element able to cooperate with first and second recessed forms provided on each side wall of the cage, each element forming a hook cooperating with a so-called first recessed form during clamping and with a so-called second recessed form during unscrewing.

6. The connecting terminal according to claim 5, wherein the first recessed form and second recessed form are produced by punching the inside of the side walls of the cage.

7. The connecting terminal according to claim 5, wherein each side wall the two recessed forms extend in a direction substantially perpendicular to the axis of the cage, the two recessed forms of one lateral wall of the lateral walls being disposed in an opposite manner to the two recessed forms of the other side wall.

8. The connecting terminal according to claim 5, wherein each first recessed form comprises a surface portion forming an attachment slope situated facing the second recessed form of the same wall, the passage via said attachment slope for the attachment element to rejoin the second recessed form leading to the disengagement of the screw.

9. The connecting terminal according to claim 5, wherein each second recessed form comprises, situated facing the first recessed form associated with it, a wall portion extending substantially perpendicularly to the axis of the cage and forming an abutment stopping rotation of the nut during an unscrewing manoeuvre generating the engagement of the clamping screw from the beginning to the end of unscrewing.

10. The connecting terminal according to claim 1, wherein the intermediate stage is formed with a plate mounted on and crimped to the interior of the cage.

11. The connecting terminal according to claim 10, wherein said plate comprises two first lugs able to be introduced into respective orifices respectively belonging to two edges respectively belonging to the two side walls at the end of insertion of the plate in the cage and two second lugs able to be introduced by crimping the sheet metal of the plate into two orifices respectively belonging to the two edges of the side walls, these edges being opposite the previous edges.

12. An electrical protection device comprising at least one upstream terminal and/or at least one downstream terminal according to claim 1.

* * * * *